US011310891B2

(12) United States Patent
Van De Sluis et al.

(10) Patent No.: US 11,310,891 B2
(45) Date of Patent: Apr. 19, 2022

(54) CONTROLLER FOR CONTROLLING A LIGHTING DEVICE

(71) Applicant: SIGNIFY HOLDING B.V., Eindhoven (NL)

(72) Inventors: Bartel Marinus Van De Sluis, Eindhoven (NL); Berent Willem Meerbeek, Veldhoven (NL); Bas Driesen, Weert (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 544 days.

(21) Appl. No.: 16/328,454

(22) PCT Filed: Aug. 22, 2017

(86) PCT No.: PCT/EP2017/071136
§ 371 (c)(1),
(2) Date: Feb. 26, 2019

(87) PCT Pub. No.: WO2018/037009
PCT Pub. Date: Mar. 1, 2018

(65) Prior Publication Data

US 2021/0289606 A1 Sep. 16, 2021

(30) Foreign Application Priority Data

Aug. 26, 2016 (EP) ..... 16185798

(51) Int. Cl.
*H05B 47/165* (2020.01)
*H05B 47/175* (2020.01)

(52) U.S. Cl.
CPC ..... *H05B 47/165* (2020.01); *H05B 47/175* (2020.01)

(58) Field of Classification Search
CPC ..... H05B 47/165; H05B 47/175
See application file for complete search history.

(56) References Cited

U.S. PATENT DOCUMENTS

2009/0111487 A1* 4/2009 Scheibe ..... H04W 4/021 455/456.6
2011/0022396 A1 1/2011 Van De Sluis et al.
(Continued)

FOREIGN PATENT DOCUMENTS

WO 2009150592 A1 12/2009
WO 2016050539 A1 4/2016

*Primary Examiner* — Daniel D Chang

(57) ABSTRACT

A controller 100 for controlling a lighting device 120 is disclosed. The controller 100 comprises a receiver 102 arranged for receiving a plurality of light scenes, wherein each light scenes is associated with a word, a display 104 for displaying a plurality of words, a user input element for receiving user input indicative of a selection of one of the plurality of words, a processor 106 for generating a lighting control command 110 based on the light scene associated with a selected word, and a communication unit 108 arranged for communicating the lighting control command 110 to the lighting device 120, wherein the processor 106 is arranged for receiving a relevance value of each light scene, and for rendering each of the plurality of words with a text property representative of the respective relevance value of the associated light scene and in a text color that matches a light color of the associated light scene.

15 Claims, 3 Drawing Sheets

200

(56) References Cited

U.S. PATENT DOCUMENTS

| | | | | |
|---|---|---|---|---|
| 2011/0035029 | A1 | 2/2011 | Yianni et al. | |
| 2012/0131099 | A1* | 5/2012 | Sorokin ..... | H05B 47/155<br>709/203 |

* cited by examiner

200

CONTROLLER FOR CONTROLLING A LIGHTING DEVICE

CROSS-REFERENCE TO PRIOR APPLICATIONS

This application is the U.S. National Phase application under 35 U.S.C. § 371 of International Application No. PCT/EP2017/071136, filed Aug. 22, 2017, which claims the benefit of European Patent Application No. 16185798.2, filed on Aug. 26, 2016. These applications are hereby incorporated by reference herein.

FIELD OF THE INVENTION

The invention relates to a controller, a lighting system and a method for controlling a lighting device. The invention further relates to a computer program product for performing the method.

BACKGROUND

Future and current home and professional environments will contain a large number of controllable lighting devices for creation of ambient, atmosphere, accent or task lighting. These lighting devices are often controlled via a user interface of a smart device (e.g. a smartphone or a tablet pc). On this user interface, a user is able to select a 'light scene', which light scene is related to light settings for one or more lighting devices. A user may, for example, select a light scene called 'sunset' that comprises control instructions for a plurality of lighting devices such that they are controlled according to colors representative of a sunset (e.g. red, orange and blue). Many existing lighting control system allow users to create light scenes themselves, but creation of such light scenes can be cumbersome, especially for novice users, or users may lack inspiration to create light scenes. Thus, there is a desire for a system that recommends light scenes to a user.

U.S. patent application 2012/0131099 A1 relates to an atmosphere program management system for large retail chains comprising a user interface for selecting an atmosphere program. The atmosphere program management system also comprises a remotely accessible server which stores atmosphere programs and a remote management client for accessing the server and providing the user interface for managing the atmosphere programs stored by the server. The user interface may comprise a list of scenes which allows selection of a desired lighting scene. The lighting scene management program is adapted to load and display a picture associated to a lighting scene upon selection of the scene in the box below the list. The user interface may also show the scenes available only for that shop, these scenes may be stored at the local lighting system controller, but also on the server, in this case such scenes may be given a special distinction (e.g. via a symbol, distinctive font or text color) on the list so that it is clear that those scenes are only available for that store.

SUMMARY OF THE INVENTION

It is an object of the present invention to provide a controller, a method and a computer program product for recommending relevant light scenes to a user.

According to a first aspect of the present invention, the object is achieved by a controller for controlling a lighting device, the controller comprising:

- a receiver arranged for receiving a plurality of light scenes, wherein each light scene is associated with a word,
- a display for displaying a plurality of words,
- a user input element for receiving user input indicative of a selection of one of the plurality of words,
- a processor for generating a lighting control command based on the light scene associated with a selected word, and
- a communication unit arranged for communicating the lighting control command to the lighting device, wherein the processor is arranged for receiving a relevance value of each light scene, and for rendering each of the plurality of words with a text property representative of the relevance value of the respective light scene and in a text color that matches a light color of the respective light scene.

The selectable light scenes are presented to a user as words via the display, and the size of each word is based on its respective relevance value. The relevance value is a value indicative of how relevant a light scene is for a user operating the controller. A word with a high relevance value may be rendered more prominent (e.g. larger) than a word with a low relevance value. Irrelevant light scenes may be rendered in a very small text size, or may not be rendered at all. This is beneficial, because the more relevant the light scene is for the user, the more prominent its word is presented on the display and the more easy it is for a user to select the most relevant light scene(s). The words are rendered in a text color that matches a color of the associated light scene. This is beneficial, because it enables a user to quickly see how the light scene will be rendered by the lighting device, and select a light scene based thereon.

In embodiments of the controller, the relevance value of each light scene is representative of a popularity value of the respective light scene. The processor of the controller may be arranged for filtering the plurality of received words associated with the light scenes based on the popularity value, and determine the text properties based on the popularity value. The popularity value may be indicative of how much other users appreciate the light scene, how often they use the light scene, etc. As a result, more popular light scenes will be presented more prominently (e.g. with a larger text size, in uppercase and/or bold) to a user than less popular light scenes.

In embodiments of the controller, the relevance value of each light scene is based on characteristics of a user profile. The user profile may for example comprise user preferences (e.g. preferences related to colors, light scenes, atmosphere, music, etc.), be related to age, gender, lighting control history, etc. and the processor may be arranged for determining of which light scenes to render the words based thereon. As a result, the text property of each word is dependent on how much the respective light scene matches the user profile. This is beneficial, because words indicative of light scenes which match the user profile will be rendered more prominent on the display than words indicative of light scenes which do not match the user profile.

In embodiments of the controller, the relevance value of each light scene is based on a current activity of the user. The processor may be arranged for determining of which light scenes to render the words based on the current activity (e.g. having dinner, watching a movie, going to bed, waking up, partying, etc.). As a result, the text property of each word is dependent on how much the respective light scene matches the activity. This is beneficial, because words indicative of light scenes which match the current activity will be rendered more prominent on the display than words indicative of light scenes which do not match the current activity.

In embodiments of the controller, the controller is arranged for accessing information indicative of at least one property of the lighting device, and the processor is arranged for determining the relevance value of each light scene by comparing each light scene with the at least one property of the lighting device. As a result, the text property of each word is dependent on to what extent the lighting device can render the light scene. This is beneficial, because not all lighting systems may be able to render a specific light scene (e.g. if a lighting system has no lighting devices that can emit colored light, it will not be able to render a colorful light scene). This is beneficial, because the size of the words indicative of light scenes which can be (fully) rendered by the lighting system will be rendered more prominent on the display than words indicative of light scenes which can be only partially rendered.

In embodiments of the controller, the light scene is a dynamic light scene having a plurality of subsequent colors, and the processor is arranged for rendering the text color of each word according to the plurality of subsequent colors over time. This embodiment provides the advantage that the user can see how the dynamic light effect will be rendered by the lighting device.

In embodiments of the controller, at least one of the light scenes is representative of at least two different light outputs for at least two lighting devices, and the processor is arranged for rendering the respective word in at least two different text colors that match at least two different light colors associated with the at least two different light outputs. This embodiment provides the advantage that the user can see how a light scene that can be applied to multiple lighting devices will be rendered by the lighting devices.

According to a second aspect of the present invention, the object is achieved by a lighting system for controlling a lighting device, the system comprising:

the lighting device, a controller according to the controller of claim 2, a server connected to a plurality of lighting systems and the controller, wherein the server is arranged for providing the popularity value to the controller, which popularity value is based on information received from individual lighting systems or from users of the individual lighting systems of the plurality of lighting systems.

In embodiments of the lighting system, the server is arranged for determining the popularity value based on a number of times that a respective light scene has been activated in the plurality of lighting systems and/or based on how long a respective light scene has been active in the plurality of lighting systems. This embodiment is advantageous, because the server automatically determines the popularity value based on data received from the plurality of lighting systems.

In embodiments of the lighting system, the server is further arranged for determining the popularity value based on user input from users operating the plurality of lighting systems. This embodiment enables users to provide input about the light scenes, which input may be used by the server to determine how popular each light scene is. In a further embodiment, the server is a social media server, and the server is further arranged for determining the popularity value based on user input received via the social media server. Users of a social media network may provide their appreciation of light scenes (e.g. by rating the light scenes) via the social media network (e.g. via a website or an application running on a smart device).

According to a third aspect of the present invention, the object is achieved by a method for controlling a lighting device, the method comprising:

receiving a plurality of light scenes, wherein each light scene is associated with a word, receiving a relevance value of each light scene, rendering each of a plurality of words with a text property representative of the relevance value of the respective light scene and in a text color that matches a light color of the respective light scene, displaying the plurality of words, receiving user input indicative of a selection of one of the plurality of words, generating a lighting control command based on the light scene associated with a selected word, communicating the lighting control command to the lighting device.

In embodiments of the method, the relevance value of each light scene is representative of a popularity value of the respective light scene.

In further embodiments of the method, the method further comprises the step of: determining the popularity value based on a number of times that a respective light scene has been activated and/or based on how long a respective light scene has been active.

According to a fourth aspect of the present invention, the object is achieved by a computer program product for a computing device, the computer program product comprising computer program code to perform any one of the above-mentioned methods when the computer program product is run on a processing unit of the computing device.

It should be understood that the claimed methods, systems and computer program product may have similar and/or identical embodiments and advantages as the claimed controller and vice versa.

In the context of the present invention, a "light scene" relates to data indicative of one or more light settings for one or more lighting devices. The light settings may relate to the color, brightness and/or intensity of the light. The data may comprise control instructions of how to control the one or more lighting devices according to the one or more light settings. The control instructions may be different for different types of lighting devices.

In the context of the present invention, a "text property" relates to the visible characteristics of the text. A characteristic may be selected to increase/decrease the prominence of a word on the display. Examples of text properties include but are not limited to: font type, text size, letter-spacing, font-weight (light/normal/bold) and text case (UPPERCASE/lowercase). Excluded from the term "text property" in the context of the present invention is the color of the text, because the color of the text is rendered such that it matches a light color of the respective light scene (and not based on the relevance value).

BRIEF DESCRIPTION OF THE DRAWINGS

The above, as well as additional objects, features and advantages of the disclosed controllers, systems and methods, will be better understood through the following illustrative and non-limiting detailed description of embodiments of devices and methods, with reference to the appended drawings, in which.

All the figures are schematic, not necessarily to scale, and generally only show parts which are necessary in order to elucidate the invention, wherein other parts may be omitted or merely suggested.

DETAILED DESCRIPTION OF EMBODIMENTS

Figure 1:
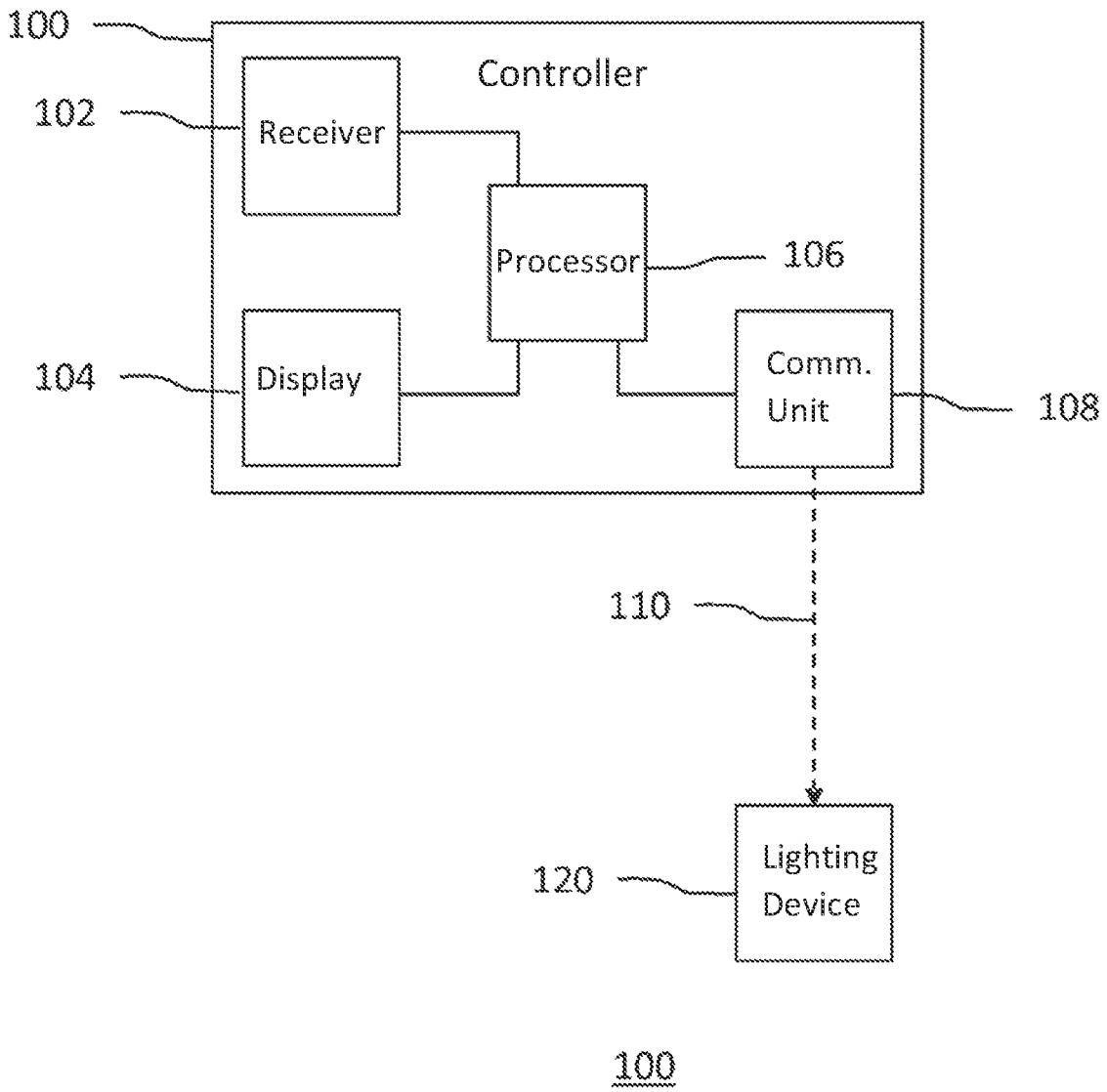
FIG. 1 shows schematically an embodiment of a controller according to the invention for controlling a lighting device.

FIG. 1 shows schematically an embodiment of a controller 100 according to the invention for controlling a lighting device 120. The controller 100 comprises a receiver 102 arranged for receiving a plurality of light scenes, wherein each light scenes is associated with a word. The controller 100 further comprises a display 104 for displaying a plurality of words and a user input element for receiving user input indicative of a selection of one of the plurality of words. The controller 100 further comprises a processor 106 (e.g. a microcontroller, a microchip, circuitry, etc.) for generating a lighting control command 110 based on the light scene associated with a selected word and a communication unit 108 arranged for communicating the lighting control command 110 to the lighting device 120. The processor 106 is arranged for receiving a relevance value of each light scene, for example via the receiver 102, and for rendering each of the plurality of words with a text property representative of the relevance value of the respective light scene and in a text color that matches a light color of the respective light scene.

The controller 100 may be (comprised in) any control device arranged for controlling lighting devices. Examples of control devices include but are not limited to smartphones, tablet pcs, smart glasses, home automation control panels, lighting control panels, remote controllers, etc.

The receiver 102 is arranged for receiving the plurality of light scenes. The receiver may be arranged for receiving the plurality of light scenes from a further device, for example a home automation system, a remote server, etc. Each of the light scenes is associated with a word, which word may be descriptive of the light scene. A light scene may, for example, comprise control instructions for lighting devices to control the lighting devices such that they emit different shades of green light, and the selectable word associated with the light scene may be 'Jungle'. Alternatively, a light scene may, for example, comprise control instructions for lighting devices to control the lighting devices according to the colors of the rainbow, and the selectable word associated with that light scene may be 'Rainbow'. The light scene may be a dynamic light scene having a plurality of subsequent colors, and the processor 106 may be arranged for rendering the text color of each word according to the plurality of subsequent colors over time. The dynamic light scene may for example be a fire color effect (a change of color of the light output of the lighting device 100 over time according to the colors red, orange and yellow light). Various wired and wireless communication protocols may be used for receiving the light scenes from the further device, for example Ethernet, DMX, DALI, USB, Bluetooth, Wi-Fi, Li-Fi, 3G, 4G or ZigBee.

The controller 100 further comprises the display 104 for displaying a plurality of words which are associated with the received light scenes. The display may, for example, be an LED, OLED and/or LCD display, or the display may comprise a projecting means for projecting the plurality of words on a surface (for example a projector for projecting the words on a wall or a microprojector projecting the words on the glasses of smart glasses).

The processor 106 is arranged for rendering each word on the display 104 in a text color that matches a light color of the associated light scene. The light scene may comprise light settings for the lighting device, which light settings may be stored as color values (e.g. RGB color values or XY values in the CIE color space). The processor 106 may be arranged for converting the light color values to display color values. If, for example, a light scene comprises control instructions for lighting devices to control the lighting devices such that they emit dark blue, light blue and white light, and the light scene is associated with the word 'Ocean', the word 'Ocean' may be rendered in one or more of these light colors (e.g. blue). The text color may be rendered in an average color of the colors of the light scene (in the previous example this may be light blue), be rendered in multiple colors (e.g. a color gradient with smooth transitions from white to light blue to dark blue, each letter of the word may have an individual color, etc.), etc.

The processor 106 is further arranged for receiving a relevance value of each light scene and for rendering each of the plurality of words with a text property representative of the relevance value of the respective light scene. The relevance value is indicative of how relevant a respective light scene is for the user operating the controller. The relevance values of the plurality of light scenes may be received via the receiver 102 together with the plurality of light scenes and the words associated therewith. Alternatively, the processor 106 may be arranged for receiving the relevance values from another source. The processor 106 may be arranged for determining the relevance values based on other data (e.g. a user profile, user preferences, user behavior, capabilities of the lighting device(s)/lighting system, etc.). Examples of relevance values and how they may be generated are discussed below. If a light scene has a high relevance value, the processor 106 may for example render the word associated with that light scene in a large text size, in a font different from light scenes with lower relevance values, in a bold font, etc. If a light scene has a low relevance value, the processor 106 may render the word associated with that light scene in a small text size, in lowercase text, in a light font, etc. The processor 106 may be further arranged for determining which words of the plurality of words to display on the display 104 based on the respective relevance values of the associated light scenes. If the relevance value of a light scene is too low, the processor 106 may determine not to display the respective word at all.

The controller 100 further comprises the user input element for receiving a user input indicative of a selection of one of the plurality of words. The user input element may for example comprise a touch-sensitive device such as a touchpad, a touchscreen or one or more buttons for receiving the user input. Another example of a user input element is a microphone. The microphone may receive voice commands indicative of a selection of one of the words. Additionally or alternatively, the user input element (such as a camera) may be arranged for detecting gestures indicative of a selection of one of the words. It should be noted that the above-mentioned user input elements are mere examples of user input elements and illustrate rather than limit the invention.

The processor 106 is arranged for generating a lighting control command 110 based on the light scene that is associated with the selected word. The lighting control command 110 may be any type of signal, message, data packet, etc. arranged to be communicated to the lighting device 120 by the communication unit 108. The communication unit 108 may transmit the message(s), signal(s) or data packet(s) via any communication protocol (e.g. Wi-Fi, ZigBee, Bluetooth, DALI, DMX, USB, power over Ethernet, power-line communication, etc.). It may be beneficial if the communication unit 108 is arranged for communicating with the lighting device 120 via a plurality of communication channels/protocols, thereby enabling the transmission of messages, signals or data packets to a plurality of types of lighting devices 120.

The relevance value of each light scene may be representative of a popularity value of the respective light scene. The popularity value of a light scene may be determined based on a number of times that the light scene has been activated by other users and/or based on how long it has been active. Additionally or alternatively, the popularity value may be based on user input from other users. Users may provide feedback regarding specific light scenes, for example by rating them. Users may, for example, rate the light scenes via a lighting control application that runs on a lighting control device (such as a smartphone), or users may rate the light scenes via a social media network. The processor 106 may receive the popularity value from a remote server, which may be connected to a plurality of lighting systems. Additionally or alternatively, the remote server may be a social media server. The remote server may gather information related to the popularity (the number of times that a respective light scene has been activated, how long it has been active, user ratings, etc.) in order to determine the popularity value and therewith the relevance value of a light scene and communicate this to the controller 100.

Additionally or alternatively, the relevance value of each light scene may be based on characteristics of a user profile. The processor 106 may be arranged for accessing the user profile and determine the relevance value based thereon. The user profile may comprise user preferences (e.g. related to colors, atmospheres, images, music, etc.), and each of these preferences may be associated with a light scene. A lookup table may store these associations, which enables the processor 106 to determine which light scene would be most relevant for a specific user. Alternatively, the processor 106 may be arranged for inferring the relevance value of a light scene from one of the user preferences. The processor may for example determine the relevance of colored light scenes based on a most prominent color in a user's favorite image.

Additionally or alternatively, the relevance value of each light scene may be determined based on a current activity of the user. The processor 106 may be arranged for accessing information indicative of the current activity of a user. The activity may be determined by the processor 106. The processor 106 may, for example, determine which applications are running on the device that comprises controller and determine the activity based thereon (e.g. watching a movie, playing a game, browsing webpages, etc.). Alternatively, the processor 106 may comprise sensors for determining the user activity (e.g. a microphone may capture audio indicative of an activity and/or a motion sensor may capture movement indicative of an activity). Alternatively, the processor 106 may receive information related to the activity from a further device, for example from a (3D depth) camera arranged for detecting user activities, and the processor 106 may be arranged for determining the relevance value of each light scene for each activity. Upon detecting a current activity, the processor 106 may render the words associated with the light scenes according to the relevance values associated with the current activity on the display 104. As a result, only light scenes which are relevant for the current activity are displayed on the display 104. Some light scenes may be more suitable for specific activities, for example watching a movie might require (colored) atmosphere lighting while reading a book may require (white) functional lighting.

Additionally or alternatively, the processor 106 may be arranged for accessing information indicative of at least one property of the lighting device 120. The information may be received from the lighting device 120 or be received from a further device (e.g. a hub, a router, a remote server, etc.). The property may be indicative of a type of lighting device 120 (e.g. an LED strip or an LED bulb), the location/orientation of the lighting device 120, the color rendering properties of the lighting device, etc. The processor 106 may be further arranged for determining the relevance value of each light scene by comparing the each light scene with the at least one property of the lighting device. If, for example, a lighting system contains only lighting devices able to render white light with different color temperatures, light scenes related to colored light may have a very low relevance value, whereas light scenes related to white light with high or low color temperatures may have a higher relevance value. If, for example, a lighting system contains only LED strips (which are typically used for atmosphere lighting and less for functional/task lighting), ambient light scenes (e.g. 'romantic' light scenes) may have higher relevance values than functional light scenes (e.g. 'office' light scenes).

The processor 106 may be further arranged for determining the relevance value based on multiple parameters. For example, the processor 106 may determine the relevance values based on popularity values and on a current activity of the user and/or on a user profile of the user.

The processor 106 may be further arranged for determining an orientation of a word based on the relevance value of the light scene that is associated with that word. Words associated with light scenes with high relevance values may be rendered horizontally and words associated with light scenes with low relevance values may be rendered vertically.

Figure 2:
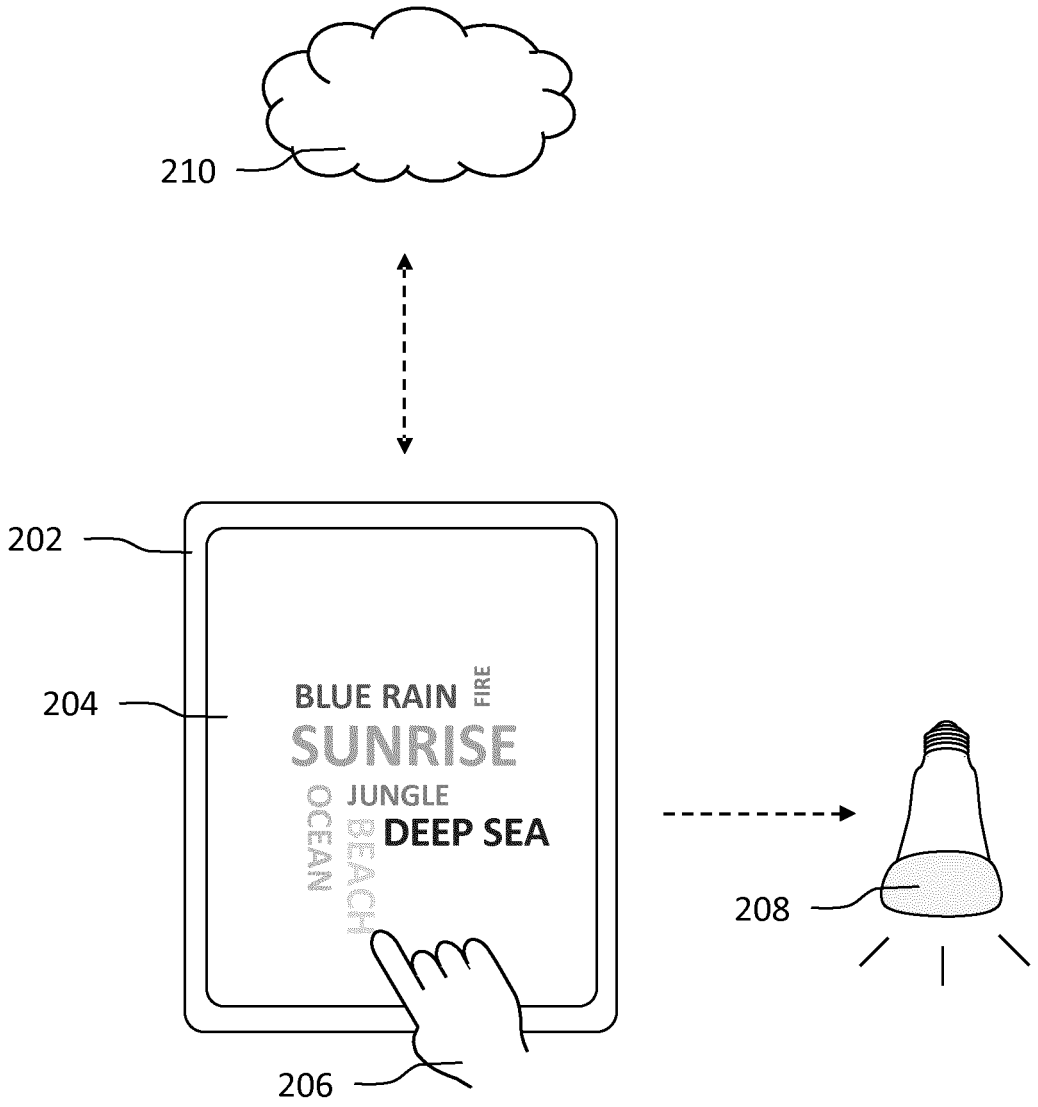
FIG. 2 shows schematically an embodiment of a lighting system according to the invention for controlling a lighting device, which lighting system comprises a user input device and a lighting device.

FIG. 2 illustrates an example of a lighting system 200 for controlling a lighting device 208, which lighting system comprises a user input device 202 and the lighting device 208. The user input device may comprise the controller 100 (not shown in FIG. 2). The user input device 202 may be arranged for communicating with a remote server 210, which server 210 may be arranged for providing light scenes and the words and the relevance values associated therewith to the input device 202. The processor (not shown) of the user input device 202 is arranged for rendering each of the plurality of words on a display 204 with a text property representative of the relevance value of the respective light scene and in a text color that matches a light color of the respective light scene. In the example of FIG. 2, the light scene 'SUNRISE' has the highest relevance value and is therefore rendered most prominent (in this example the largest) on the display 204 of the user input device 202, whereas the light scene 'FIRE' has the lowest relevance value and is therefore rendered smallest on the display 204. A user may select one of the words by providing a tap input 206 on the touch screen 204. Upon selecting a word, for example 'BEACH', the processor of the user input device 202 may generate a lighting control command based on the light scene associated with that word, whereupon the lighting control command is communicated to the lighting device 208, and the lighting device 208 is controlled according to the light scene associated with the word 'BEACH'.

Figure 3:
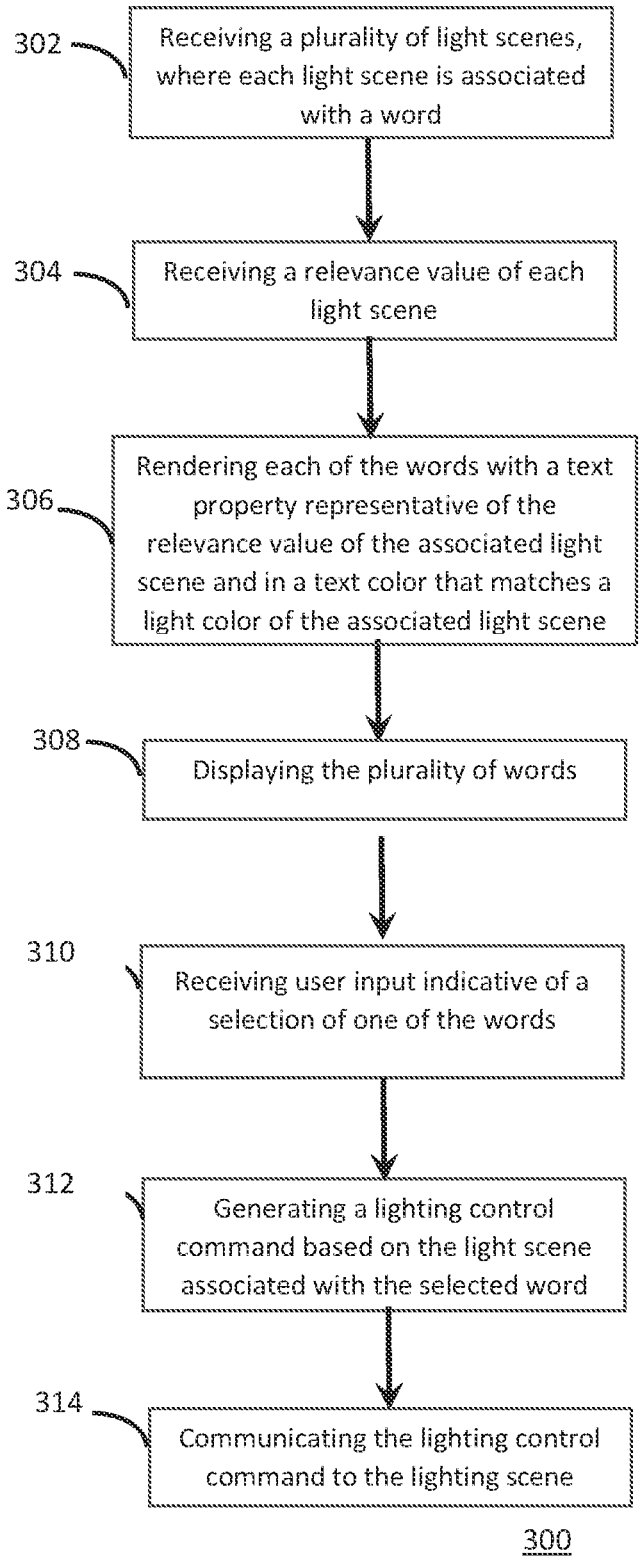
FIG. 3 shows the steps of a method according to the invention for controlling a lighting device.

FIG. 3 shows the steps of a method 300 according to the invention for controlling a lighting device. The method comprises the steps of:

receiving 302 a plurality of light scenes, wherein each light scene is associated with a word, receiving 304 a relevance value of each light scene, rendering 306 each of a plurality of words with a text property representative of the respective relevance value of the associated light scene and in a text color that matches a light color of the associated light scene, displaying 308 the plurality of words, receiving 310 user input indicative of a selection of one of the plurality of words, generating 312 a lighting control command based on the light scene associated with a selected word, communicating 314 the lighting control command to the lighting device.

The method may further comprise the step of: determining the popularity value based on a number of times that a respective light scene has been activated and/or based on how long a respective light scene has been active. The method may be performed by computer program code of a computer program product when the computer program product is run on a processing unit of a computing device, such as the processor 106.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer or processor. In the device claim enumerating several means, several of these means may be embodied by one and the same item of hardware. The mere fact that certain measures are recited in mutually different dependent claims does not indicate that a combination of these measures cannot be used to advantage.

Aspects of the invention may be implemented in a computer program product, which may be a collection of computer program instructions stored on a computer readable storage device which may be executed by a computer. The instructions of the present invention may be in any interpretable or executable code mechanism, including but not limited to scripts, interpretable programs, dynamic link libraries (DLLs) or Java classes. The instructions can be provided as complete executable programs, partial executable programs, as modifications to existing programs (e.g. updates) or extensions for existing programs (e.g. plugins). Moreover, parts of the processing of the present invention may be distributed over multiple computers or processors.

Storage media suitable for storing computer program instructions include all forms of nonvolatile memory, including but not limited to EPROM, EEPROM and flash memory devices, magnetic disks such as the internal and external hard disk drives, removable disks and CD-ROM disks. The computer program product may be distributed on such a storage medium, or may be offered for download through HTTP, FTP, email or through a server connected to a network such as the Internet.

The invention claimed is:

1. A controller for controlling a lighting device, the controller comprising:

a receiver arranged for receiving a plurality of light scenes, wherein each light scene is associated with a word, a display for displaying a plurality of words, a user input element for receiving user input indicative of a selection of one of the plurality of words, a processor for generating a lighting control command based on the light scene associated with a selected word, and a communication unit arranged for communicating the lighting control command to the lighting device, wherein the processor is arranged for receiving a relevance value of each light scene, and for rendering each of the plurality of words with a text property representative of the relevance value of the respective light scene and in a text color that matches a light color of the respective light scene.

2. The controller of claim 1, wherein the relevance value of each light scene is representative of a popularity value of the respective light scene.

3. The controller of claim 1, wherein the relevance value of each light scene is based on characteristics of a user profile.

4. The controller of claim 1, wherein the relevance value of each light scene is based on a current activity of the user.

5. The controller of claim 1, wherein the controller is arranged for accessing information indicative of at least one property of the lighting device, and wherein the processor is arranged for determining the relevance value of each light scene by comparing the each light scene with the at least one property of the lighting device.

6. The controller of claim 1, wherein the light scene is a dynamic light scene having a plurality of subsequent colors, and wherein the processor is arranged for rendering the text color of each word according to the plurality of subsequent colors over time.

7. The controller of claim 1, wherein at least one of the light scenes is representative of at least two different light outputs for at least two lighting devices, and wherein the processor is arranged for rendering the respective word in at least two different text colors that match at least two different light colors associated with the at least two different light outputs.

8. A lighting system for controlling a lighting device, the system comprising the lighting device, a controller according to the controller of claim 2, a server connected to a plurality of lighting systems and the controller, wherein the server is arranged for providing the popularity value to the controller, which popularity value is based on information received from individual lighting systems or from users of the individual lighting systems of the plurality of lighting systems.

9. The lighting system of claim 8, wherein the server is arranged for determining the popularity value based on a number of times that a respective light scene has been activated in the plurality of lighting systems and/or based on how long a respective light scene has been active in the plurality of lighting systems.

10. The lighting system of claim 8, wherein the server is further arranged for determining the popularity value based on user input from users operating the plurality of lighting systems.

11. The lighting system of claim 10, wherein the server is a social media server, and wherein the server is further arranged for determining the popularity value based on user input received via the social media server.

12. A method for controlling a lighting device, the method comprising:

receiving a plurality of light scenes, wherein each light scene is associated with a word, receiving a relevance value of each light scene, rendering each of a plurality of words with a text property representative of the relevance value of the respective light scene and in a text color that matches a light color of the respective light scene, displaying the plurality of words, receiving user input indicative of a selection of one of the plurality of words, generating a lighting control command based on the light scene associated with a selected word, and communicating the lighting control command to the lighting device.

13. The method of claim 12, wherein the relevance value of each light scene is representative of a popularity value of the respective light scene.

14. The method of claim 13, further comprising:

determining the popularity value based on a number of times that a respective light scene has been activated and/or based on how long a respective light scene has been active.

15. A computer program product for a computing device, the computer program product comprising computer program code to perform the method of claim 12 when the computer program product is run on a processing unit of the computing device.

* * * * *